US010184768B2

(12) United States Patent
Luis y Prado

(10) Patent No.: US 10,184,768 B2
(45) Date of Patent: Jan. 22, 2019

(54) ARROWHEAD HOLDER

(71) Applicant: Workshops for Warriors, San Diego, CA (US)

(72) Inventor: Hernán Luis y Prado, San Diego, CA (US)

(73) Assignee: Workshops for Warriors, San Diego, CA (US)

( * ) Notice: Subject to any disclaimer, the term of this patent is extended or adjusted under 35 U.S.C. 154(b) by 38 days.

(21) Appl. No.: 15/382,491

(22) Filed: Dec. 16, 2016

(65) Prior Publication Data

US 2018/0172413 A1 Jun. 21, 2018

(51) Int. Cl.

| | |
|---|---|
| ***B65D 85/20*** | (2006.01) |
| ***F42B 39/00*** | (2006.01) |
| ***B65D 25/10*** | (2006.01) |
| ***B65D 25/28*** | (2006.01) |
| ***B65D 43/16*** | (2006.01) |
| ***B65D 43/22*** | (2006.01) |
| ***B65D 55/02*** | (2006.01) |
| *F42B 6/08* | (2006.01) |

(52) U.S. Cl.

CPC ..... *F42B 39/007* (2013.01); *B65D 25/108* (2013.01); *B65D 25/28* (2013.01); *B65D 43/16* (2013.01); *B65D 43/22* (2013.01); *B65D 55/02* (2013.01); *F42B 6/08* (2013.01)

(58) Field of Classification Search

CPC ..... F42B 39/007; F42B 6/08; B65D 25/108; B65D 25/28; B65D 43/16; B65D 43/22; B65D 55/02

USPC ..... 206/315.1, 315.11, 579, 818

See application file for complete search history.

(56) References Cited

U.S. PATENT DOCUMENTS

| | | | | | |
|---|---|---|---|---|---|
| 5,344,012 | A * | 9/1994 | Matthews | B25H 3/06 | 206/372 |
| 5,690,088 | A * | 11/1997 | Ruble | F41B 5/066 | 124/25.7 |
| 5,855,285 | A * | 1/1999 | Laird | B25H 3/003 | 206/378 |
| 6,390,294 | B1 * | 5/2002 | Fiore, Jr. | A63B 71/0036 | 124/86 |
| 6,702,112 | B1 * | 3/2004 | Henderson | B25H 3/003 | 206/350 |
| 7,942,141 | B1 * | 5/2011 | Love | F41B 5/066 | 124/25.5 |
| 8,240,512 | B2 * | 8/2012 | Sunatori | B65D 51/242 | 206/818 |
| 2005/0258059 | A1 * | 11/2005 | Joyce | B25H 3/003 | 206/378 |
| 2014/0097101 | A1 * | 4/2014 | Paschke | A45C 5/03 | 206/3 |

* cited by examiner

*Primary Examiner* — Luan K Bui
(74) *Attorney, Agent, or Firm* — Fish & Richardson P.C.

(57) ABSTRACT

An arrowhead holder includes a rigid plate having a top surface and a bottom surface, and recesses formed in the top surface of the rigid plate, each recess shaped and sized to receive a shaft portion of an arrowhead. The recesses are distributed across the rigid plate at a spacing sufficient to accommodate an arrowhead being placed in each of the recesses. Magnets are disposed in the recesses, each magnet configured to securely retain an arrowhead inserted in an associated recess through magnetic attraction between a magnet and a respective shaft portion of an arrowhead.

5 Claims, 5 Drawing Sheets

ARROWHEAD HOLDER

FIELD

This specification generally relates to a device for safely and securely holding arrowheads.

BACKGROUND

An arrowhead is a tip, usually pointed or sharpened, disposed on a leading end of an arrow. A primary purpose of an arrowhead is to pierce an object (e.g., archery target, game animal) that the arrow has struck in termination of its flight. Types of arrowheads include target points, which are bullet-shaped with a sharp point, and designed to penetrate archery targets easily without causing excessive damage. Broadheads, in contrast, are arrowheads formed typically of two or three razor sharp fins coming to a point, and which are designed to inflict maximum damage (e.g., massive bleeding and/or cutting of tissue) to the object that the arrow has struck. Originally used for both war and bow hunting, broadheads remain in popular use for bow hunting game animals such as deer. While out hunting, bow hunters typically carry multiple different arrowheads with them, which can be attached and detached from arrow shafts as needed.

SUMMARY

In general, one aspect of the subject matter described in this specification may be embodied in an arrowhead holder that includes a rigid plate having a top surface and a bottom surface, and recesses formed in the top surface of the rigid plate, each recess shaped and sized to receive a shaft portion of an arrowhead. The recesses are distributed across the rigid plate at a spacing sufficient to accommodate an arrowhead being placed in each of the recesses. Magnets are disposed in the recesses, each magnet configured to securely retain an arrowhead inserted in an associated recess through magnetic attraction between a magnet and a respective shaft portion of an arrowhead.

In an implementation, the rigid plate is composed of one or more of steel, plastic, or composite material.

The recesses may be distributed across the rigid plate at a spacing sufficient to accommodate a broadhead arrowhead being placed in each of the plurality of recesses.

An arrowhead holding system includes a rigid plate having a top surface and a bottom surface; recesses formed in the top surface of the rigid plate, each recess shaped and sized to receive a shaft portion of an arrowhead, the plurality of recesses distributed across the rigid plate at a spacing sufficient to accommodate an arrowhead being placed in each recess; magnets disposed in the recesses, each magnet configured to securely retain an arrowhead inserted in an associated recess through magnetic attraction between a magnet and a respective shaft portion of an arrowhead; and a water-resistant, crush-resistant case that is sized and shaped to accommodate and securely hold the rigid plate.

The case may be sufficiently large to hold a rigid plate fully loaded with an arrowhead (e.g., a broadhead) inserted into each of the recesses.

Details of one or more implementations of the subject matter described in this specification are set forth in the accompanying drawings and the description below. Other features, aspects, and potential advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
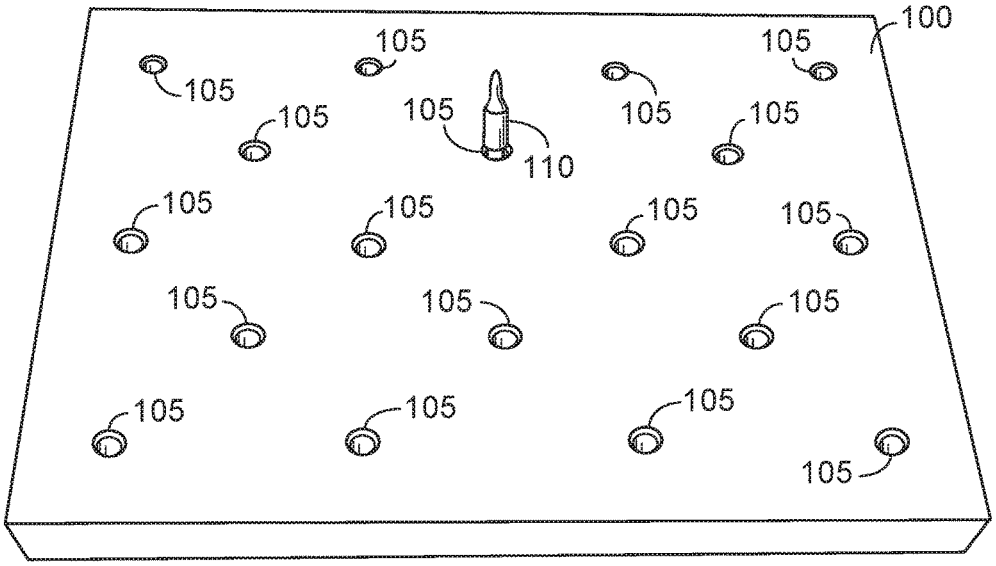
FIG. 1 is a front perspective view of an arrowhead holder.

FIG. 1 is a front perspective view of an arrowhead holder 100 having multiple holes (equivalently, voids or recesses) 105 configured to receive a shaft portion of an arrowhead. As shown, the arrowhead holder 100 is holding only a single, target point arrowhead 110, but is configured to hold up to 18 arrowheads corresponding to the quantity of holes 105 in this example. The holes 105, which in this example are formed as cylindrical voids that extend from a top surface of the arrowhead holder 100 to a bottom surface of the arrowhead holder 100, are appropriately sized and shaped to allow a shaft portion of an arrowhead 110 to be inserted without either undue effort or excessive play or looseness. In addition, the holes 105 are spaced about the surface of the arrowhead holder 100 in a manner that tends to optimize the quantity of arrowheads that can be held, while permitting a user (e.g., a bow hunter) easy access to the arrowhead of his or her choice. In addition, the spacing of the holes 105 is designed to allow different sizes and shapes of arrowheads (e.g., not only target points but also broadheads) to be inserted and held in adjacent holes 105 without making contact or otherwise interfering with each other. Other sizes, shapes, arrangements, and/or quantities of holes 105 may be used as desired.

Figure 2:
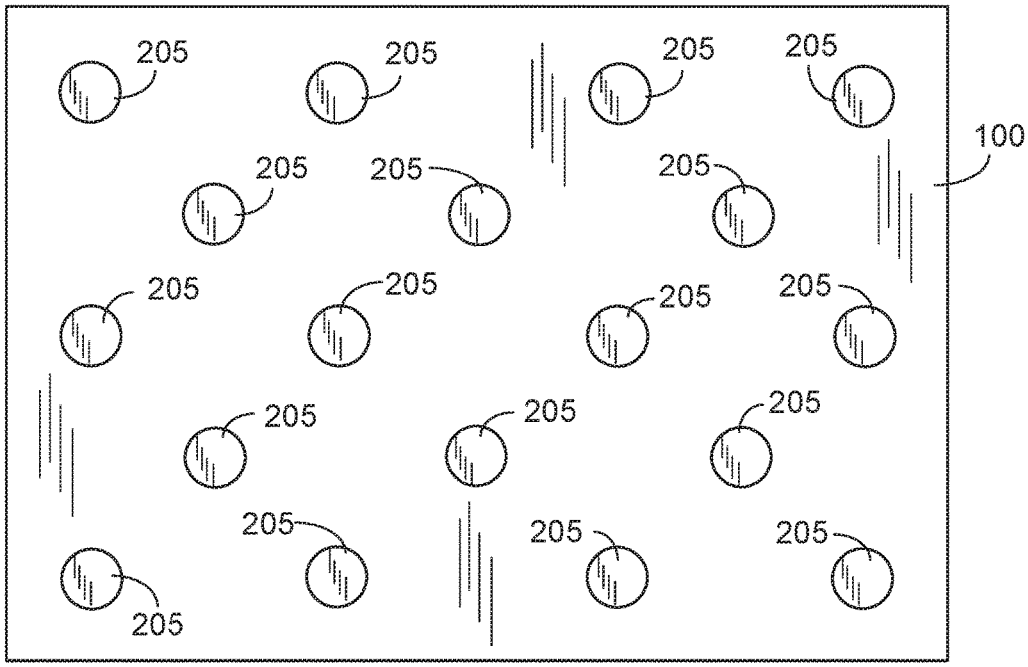
FIG. 2 is a bottom plan view of an arrowhead holder.

FIG. 2 is a bottom plan view of the arrowhead holder 100. As shown, each of the holes 105 has an associated magnet 205 inserted and affixed (e.g., using glue or other adhesive or affixing means) therein. The magnets 205 are formed as cylinders that fit snugly inside the cylindrical holes 105, such that bottom surfaces of the magnets 205 are substantially flush with the bottom surface of the arrowhead holder 100. The magnets 205 are formed to be shorter than the holes 105 such that the magnets 205 occupy less than the entire cylindrical void formed by each hole 105, thereby permitting at least partial insertion of a shaft portion of an arrowhead. Typically, an arrowhead, such as the target point 110 shown in FIG. 1, is inserted from the top surface of the arrowhead holder 100, and travels downward until a bottom surface of the arrowhead shaft comes into physical contact with a top surface of the corresponding magnet 205. Because arrowhead shafts typically are made from magnetically susceptible materials (e.g., steel), a magnet 205 will magnetically attract, and securely hold in place, an arrowhead 110 even when the arrowhead holder 100 is turned upside downside or otherwise moved about. Other sizes, shapes and/or configurations of magnets 205 may be used as desired.

Figure 3:
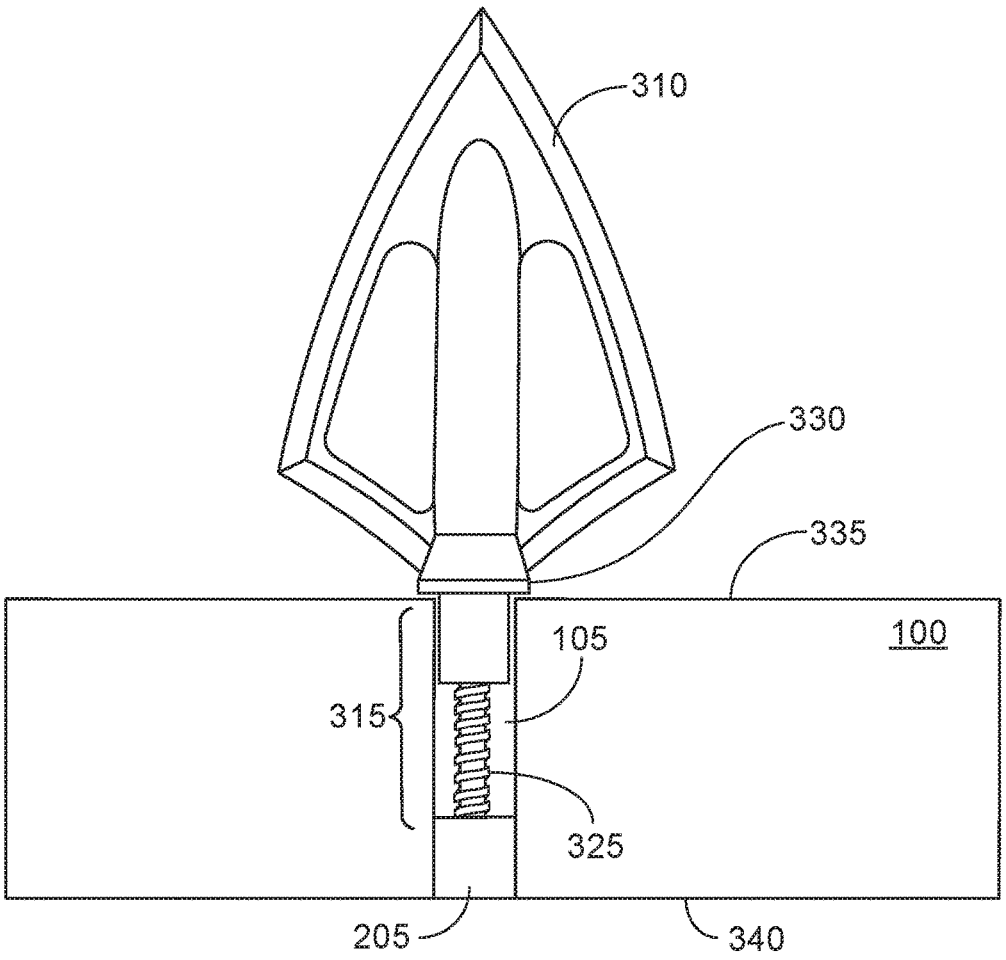
FIG. 3 is a side, cross-sectional view of an arrowhead holder.

FIG. 3 is a side, cross-sectional view of the arrowhead holder 100 in which a broadhead arrowhead 310 is inserted into hole 105. As shown, the hole 105 is sufficiently deep such that a shaft portion 315 (which, e.g., is formed of an upper portion 320 and a lower, threaded portion 325) of arrowhead 310 can be fully inserted in hole 105 such that a flange portion 330 of arrowhead 330 may rest upon a top surface 335 of the arrowhead holder 100. In addition, as previously described, the magnet 205 is disposed in hole 105 such that one end of the magnet 205 is substantially flush with a bottom surface 340 of the arrowhead holder 310, and a top end of the magnet 205 is enveloped inside hole 105. The height of the magnet 105 is such that an end of the shaft portion 315, when fully inserted into the hole 105, comes into contact with the top end of the magnet 205, and is urged toward the magnet 205 by a magnetic force to hold the arrowhead 310 securely and safely within the arrowhead holder 100.

Figure 4:
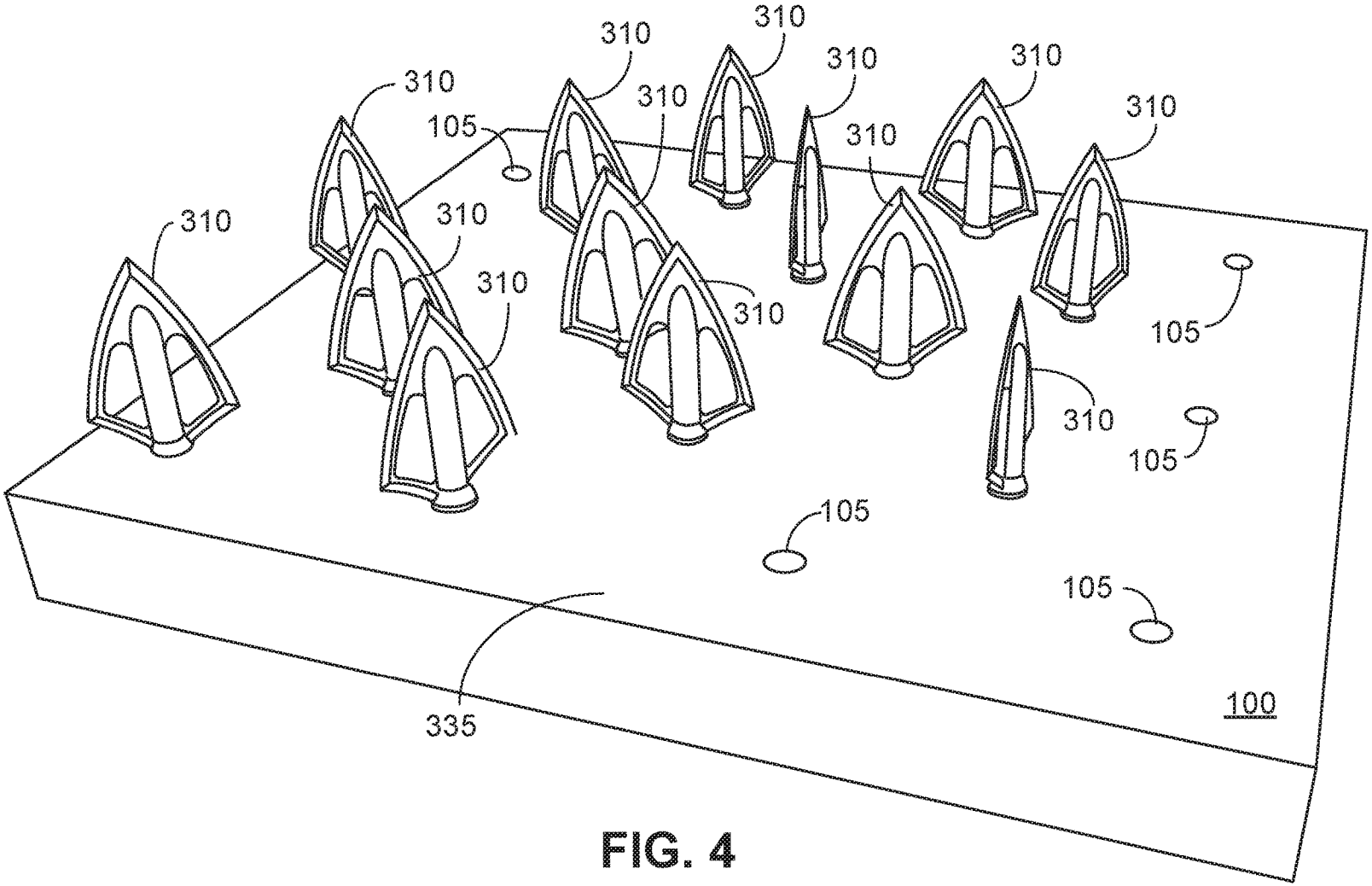
FIG. 4 is a front perspective view of an arrowhead holder.

FIG. 4 is a front perspective view of the arrowhead holder 100, showing an example configuration in which thirteen broadhead arrowheads 310 are inserted into respective holes 105, thus being held in place by respective magnets 205 (not shown). As can be seen from FIG. 4, the arrangement of holes 105 on the top surface 335 of the arrowhead holder 100 is such that the arrowheads 310—even though they are a relatively large type of arrowhead (i.e., broadheads), and even though they are positioned in various different orientations—can be safely and securely held in the arrowhead holder 100 without contacting or otherwise interfering with each other. Different configurations are possible, however, in which two or more holes 105 are spaced sufficiently close to each other such that arrowheads (e.g., broadheads) inserted in those holes 105 may come into contact with each other, depending on orientation of placement. Other configurations of holes 105 are possible depending on design and operational preferences.

Figure 5:
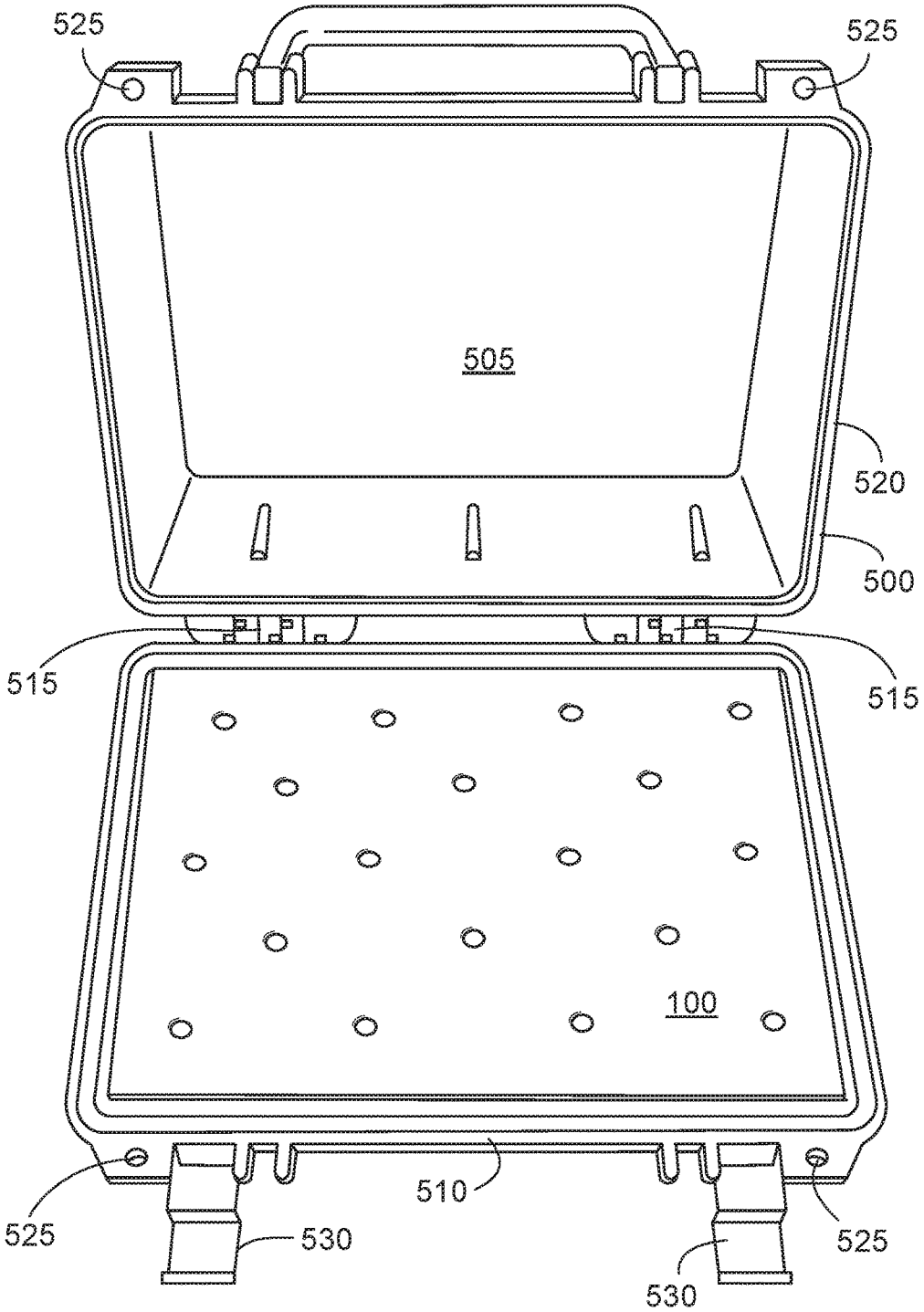
FIG. 5 is a top view of an arrowhead holder inside a case.
Figure 6:
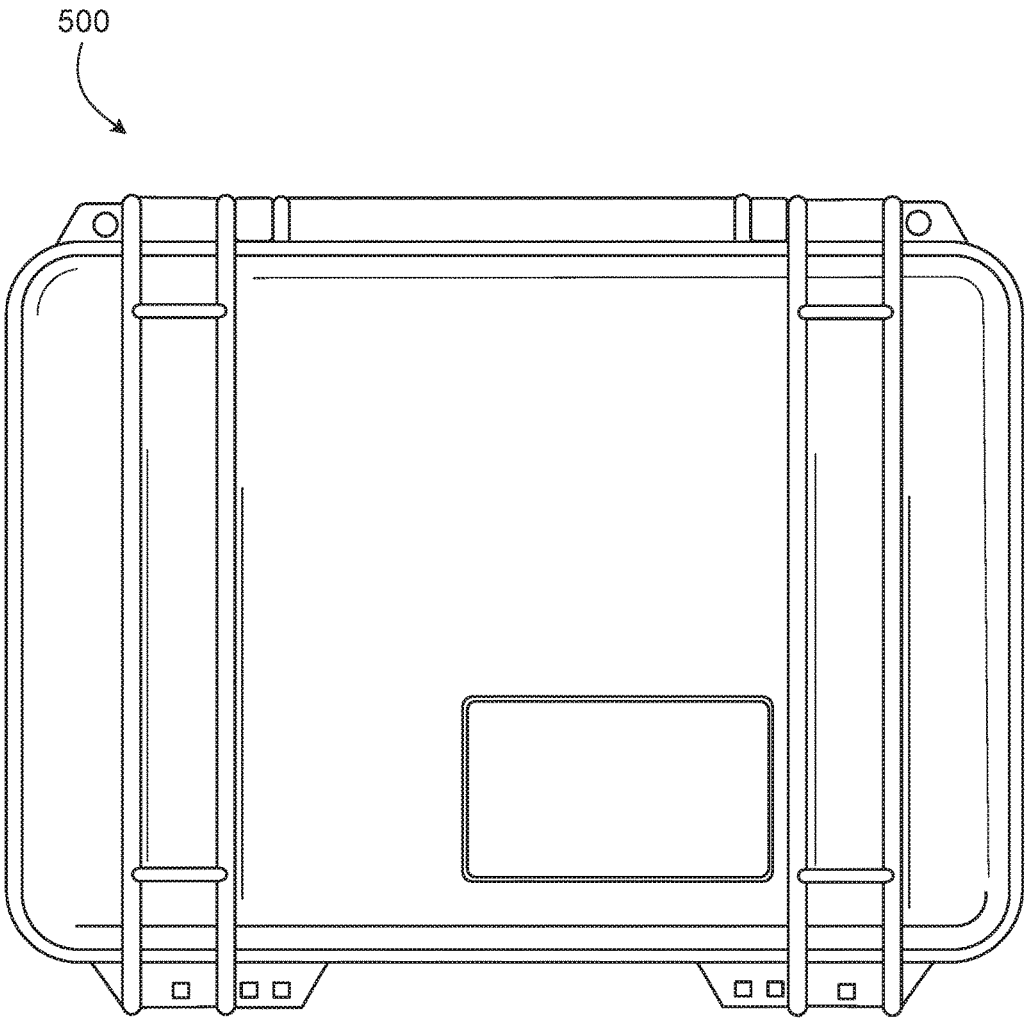
FIG. 6 is top plan view of a case for an arrowhead holder.

FIG. 5 is a top view of the arrowhead holder 100 inside a case 500. As shown, the case 500 is formed of a lid 505 and a base 510 connected by hinges 515, such that the lid 505 can be opened and closed as desired, and secured when in the closed state by clasps 530. In addition, the case 500 may have a gasket 520 around a perimeter of the lid 505 (and/or base 510) that is configured to cause the case 500 to be water-resistant when the lid 505 of the case 500 is closed and secured by clasps 530. The respective depths of the lid 505 and the base 510 are sufficiently deep such that they can accommodate most, if not all, standard arrowheads to be inserted into the holes in a manner that the lid 505 can be completely closed, and secured by clasps 530, without damaging the arrowheads contained therein. The case may also have locking holes 525 to accommodate one or more locks (not shown) to secure the arrowheads therein against theft. Optimally, the case 500 is made of a water-proof, resilient, light-weight material such as polypropylene or other plastic or composite. The light-weight and waterproof characteristics of the case enable an archer using the case 500 to carry his or her arrowheads into the field without excessive weight, and with confidence, knowing that they will be securely held in place, and will not be exposed to the elements. In this example, as shown in FIG. 6 (top plan view), the case 500 is a PELICAN brand case, model no. 1150.

What is claimed is:

1. An arrowhead holding system comprising:

a rigid plate having a top surface and a bottom surface;

a plurality of recesses formed in the top surface of the rigid plate, each recess shaped and sized to receive a shaft portion of an arrowhead, the plurality of recesses distributed across the rigid plate at a spacing sufficient to accommodate an arrowhead being placed in each of the plurality of recesses;

a plurality of magnets disposed in the plurality of recesses, each magnet configured to securely retain an arrowhead inserted in an associated recess through magnetic attraction between a magnet and a respective shaft portion of an arrowhead; and a water-resistant, crush-resistant case that is sized and shaped to accommodate and securely hold the rigid plate.

2. The arrowhead holding system of claim 1 wherein the case is sufficiently large to hold a rigid plate fully loaded with an arrowhead inserted into each of the plurality of recesses.

3. The arrowhead holding system of claim 1 wherein the case is sufficiently large to hold a rigid plate fully loaded with a broadhead arrowhead inserted into each of the plurality of recesses.

4. The arrowhead holding system of claim 1 wherein the rigid plate is composed of one or more of steel, plastic, or composite material.

5. The arrowhead holding system of claim 1 wherein the plurality of recesses distributed across the rigid plate at a spacing sufficient to accommodate a broadhead arrowhead being placed in each of the plurality of recesses.

* * * * *